US006154960A

United States Patent [19]

Baldantoni et al.

[11] Patent Number: 6,154,960

[45] Date of Patent: Dec. 5, 2000

[54] ENHANCEMENTS TO A HEAT EXCHANGER MANIFOLD BLOCK FOR IMPROVING THE BRAZEABILITY THEREOF

[75] Inventors: Antonio Baldantoni, Ann Arbor, Mich.; William Cagle, Pearl, Miss.

[73] Assignee: Norsk Hydro a.s., Oslo, Norway

[21] Appl. No.: 09/304,771

[22] Filed: May 4, 1999

Related U.S. Application Data

[60] Provisional application No. 60/084,311, May 5, 1998.

[51] Int. Cl.[7] ..... F28F 7/00; F28F 9/00

[52] U.S. Cl. ..... 29/890.054; 165/79; 165/178; 165/185; 285/289.1

[58] Field of Search ..... 165/178, 79; 29/890.054; 285/288.1, 289.1

[56] References Cited

U.S. PATENT DOCUMENTS 5,209,290 5/1993 Chigira ..... 165/178 X
5,975,193 11/1999 Tokita et al. ..... 165/79

FOREIGN PATENT DOCUMENTS 516413 12/1992 European Pat. Off. .
747650 12/1996 European Pat. Off. .
82121 1/1998 European Pat. Off. .

*Primary Examiner*—Leonard Leo
*Attorney, Agent, or Firm*—Gary M. Hartman; Domenica N. S. Hartman

[57] ABSTRACT

A method for enhancing the brazeability of a heat exchanger manifold block (110) by promoting the braze metal flow in and around the manifold block (110) during brazing within a braze furnace. The invention is particularly directed to enhancing a brazement between a manifold block (110) and a jumper tube (124) that fluidically connects the block (110) to another component of the heat exchanger system. The method entails increasing the rate of convective and radiative heat transfer to the block (110) during brazing within a braze furnace by providing fins (116, 128), grooves (118, 130) or similar features on one or more surfaces of the block (110) that increase the surface area of the block (110), and consequently increase the heating rate of the block (110) to something closer to that of the tube (124). In effect, the surface features increase the heat transfer rate of the block (110) to compensate for the disparate thermal masses of the block (110) and tube (124). The fins (116, 128) and grooves (118, 130) have been found to promote the flow of braze metal toward the block (110), which in turn has been found to promote the quality of the resulting brazement between the block (110) and tube (124).

20 Claims, 2 Drawing Sheets

ENHANCEMENTS TO A HEAT EXCHANGER MANIFOLD BLOCK FOR IMPROVING THE BRAZEABILITY THEREOF

This utility patent application claims the benefit of U.S. Provisional Application No. 60/084,311, filed May 5, 1998.

BACKGROUND OF THE INVENTION

1. Field of the Invention

The present invention generally relates to brazing techniques for heat exchangers, and more particularly to a method for promoting the quality of a brazement that joins a tube to a manifold block.

2. Description of the Prior Art

Heat exchangers for automotive applications typically have tubes interconnected between a pair of manifolds. Inlet and outlet fittings are mounted to one or both manifolds, to which supply and return pipes are connected for transporting a cooling fluid to and from the heat exchanger. Inlet/outlet manifold blocks are often used as an alternative to fittings, with one manifold block typically being brazed to each manifold. A jumper tube may be brazed to the block to provide a more reliable fluidic connection between the block to another component of the heat exchanger system.

FIG. 1 shows a manifold block 10 configured in accordance with the prior art to include a flange 12 for mounting the block 10 to a manifold (not shown), and a port hole 14 for receiving a jumper tube (not shown). In accordance with conventional practice, after appropriately preparing the block 10, tube and manifold, the flange 12 of the block 10 is mated to the manifold, the tube is placed in the port hole 14, and then the block 10 is brazed to the tube and manifold during a braze cycle performed in a furnace. While adequate brazements can be achieved with manifold blocks of the type shown in FIG. 1, improved brazeability characterized by more uniform brazements between the block 10, tube and manifold would be desirable.

SUMMARY OF THE INVENTION

According to the present invention, there is provided a method for enhancing the brazeability of a heat exchanger manifold block by promoting the braze metal flow in and around the manifold block during brazing within a braze furnace.

The invention is particularly directed to enhancing a brazement between a manifold block and a tube, such as a jumper tube that fluidically connects the manifold block to another component of the heat exchanger system. The method entails increasing the rate of convective and radiative heat transfer to the manifold block during brazing within a braze furnace by providing fins, grooves or similar features on the surface of the manifold block that increase the surface area of the block, and consequently increase the heating rate of the block to something closer to that of the tube. In effect, the surface features increase the heating rate of the block to compensate for the disparate thermal masses of the block and tube. According to the invention, such surface features have been found to promote the flow of braze metal toward the block, which in turn has been found to promote the quality of the resulting brazement between the block and tube.

The objects and advantages of this invention will be better appreciated from the following detailed description.

DETAILED DESCRIPTION OF THE PREFERRED EMBODIMENT

Figure 1:
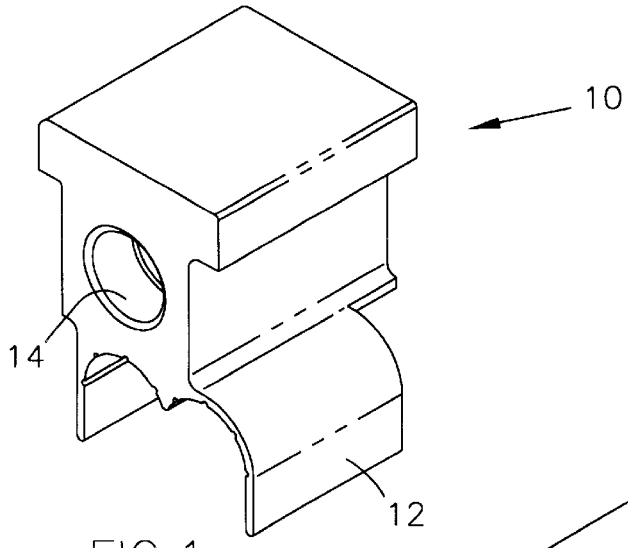
FIG. 1 shows a prior art manifold block with a port hole into which a jumper tube is to be inserted for brazing.
Figure 2:
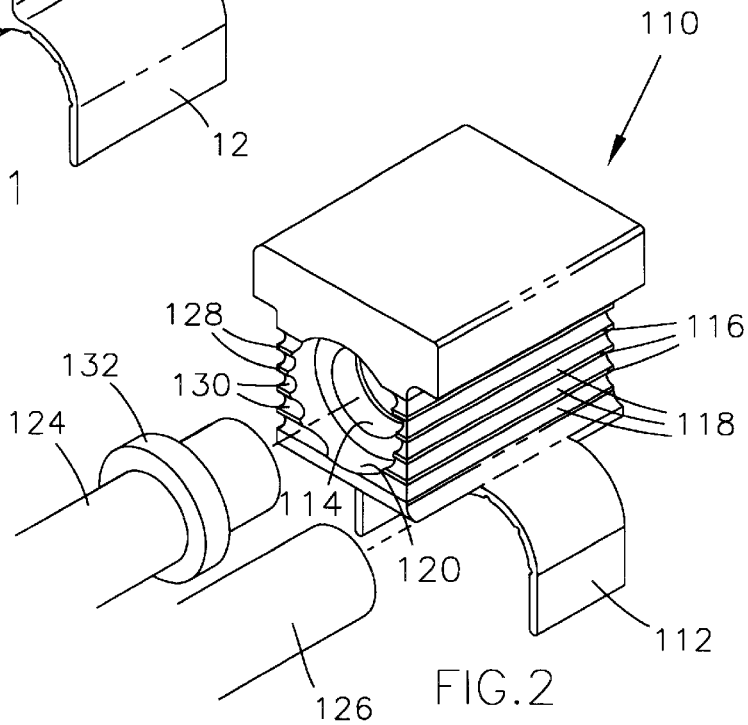
FIG. 2 shows a manifold block of the type shown in FIG. 1 but modified in accordance with this invention to include longitudinal and lateral fins, a counterbored port hole, and an undercut mounting flange.
Figure 3:
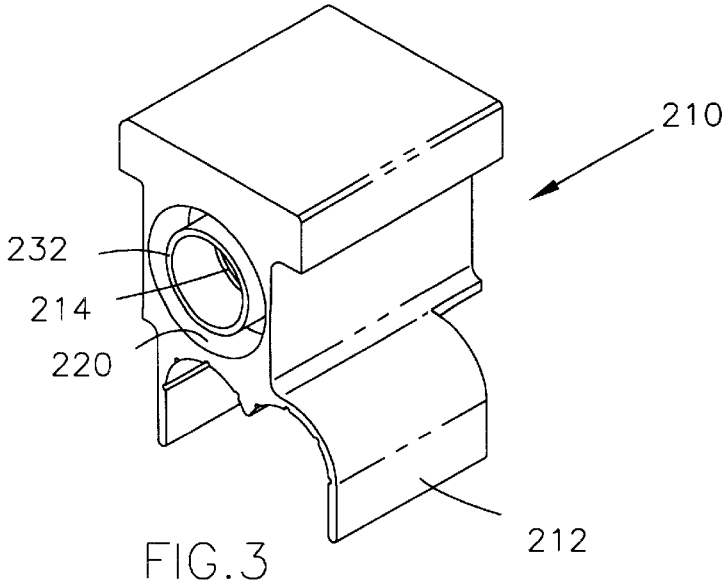
FIG. 3 shows a manifold block of the type shown in FIG. 1, but modified in accordance with this invention to include a cylindrical boss surrounding the port hole.

FIGS. 2 and 3 show embodiments of manifold blocks 110 and 210 of the type shown in FIG. 1, but modified according to the present invention to promote the formation of improved brazements between the blocks 110 and 210 and a jumper tube 124 (FIG. 2) as a result of increasing the heating rate of the blocks 110 and 210 to something closer to the jumper tube 124. The surface enhancements are also preferably configured to improve the flow and retention of molten braze alloy at the joints between the blocks 110 and 210 and tube 124. While specifically described with reference to brazing a jumper tube 124, similar surface enhancements could be employed to yield enhanced brazements between the manifold blocks 110 and 210 and other manifold components of lesser thermal mass.

FIG. 2 is an exploded view showing the manifold block 110 and a jumper tube 124, manifold 126 and preform braze ring 132. The block 110 has been modified in accordance with this invention to include longitudinal fins 116 across opposite longitudinal surfaces of the block 110 and lateral fins 128 across a lateral end surface of the block 110. The fins 116 and 128 are shown as being defined by grooves 118 and 130, respectively, formed in the surfaces of the block 110, though it is foreseeable that the fins 116 and 128 could be formed otherwise. Furthermore, the shape of the fins 116 and 128 and grooves 118 and 130 could differ from that shown. The grooves 118 are preferably incorporated into the base extrusion used to fabricate the block 110, while the lateral fins 128 are preferably formed by machining the grooves 130 into the surface of the block 110 adjacent the port hole 114. The fins 116 and 128 promote convective and radiative heat transfer to the block 110 in the environment of a brazing furnace, thereby increasing the heating rate of the block 110 to something closer to that of the tube 124 that will be placed in the port hole 114 and then brazed to the block 110. Though the fins 116 and 128 are shown as being used together on the block 110, it is foreseeable that suitable results could be obtained for manifold blocks equipped with only one of the sets of fins 116 or 128.

The block 10 of FIG. 2 has been further modified with a counterbore 120 surrounding the port hole 114. The counterbore 120 is preferably sized to serve as a reservoir for molten braze metal during the braze cycle, and also serves to prevent the molten braze metal from flowing away from the tube/block joint and toward the fins 116 and 128, which are hotter than the block 110 and tube 124 during the braze operation as a result of their low thermal mass and the enhanced convective and radiative heat transfer to the fins 116 and 128. The ability of the counterbore 120 to prevent molten braze metal from flowing away from the tube/block joint and toward the lateral fins 128 is particularly critical because of the proximity of the lateral fins 128 to the port hole 114. The counterbore 120 can also serve to receive the braze ring 132 that is placed around the tube 124 prior to brazing, and subsequently serves as the source of the braze metal during the braze cycle.

Finally, the block 10 shown in FIG. 2 is shown as being modified to include an undercut mounting flange 112, which differs from the flange 12 of FIG. 1 by the elimination of that portion of the flange 12 in the immediate vicinity of the port hole 114, as can be seen from a comparison of FIGS. 1 and 2. The undercut mounting flange 112 serves to promote faster heating of the tube/block joint 110 by exposing additional surface area of the block 110 near the port hole 114 to convective heat transfer. The undercut mounting flange 112 also eliminates contact between the manifold 126 and the block 110 in the immediate vicinity of the port hole 114. Doing so has been shown to prevent the molten braze metal from being drawn away from the tube/block joint and toward the manifold 126 under the affect of gravity.

Figure 4:
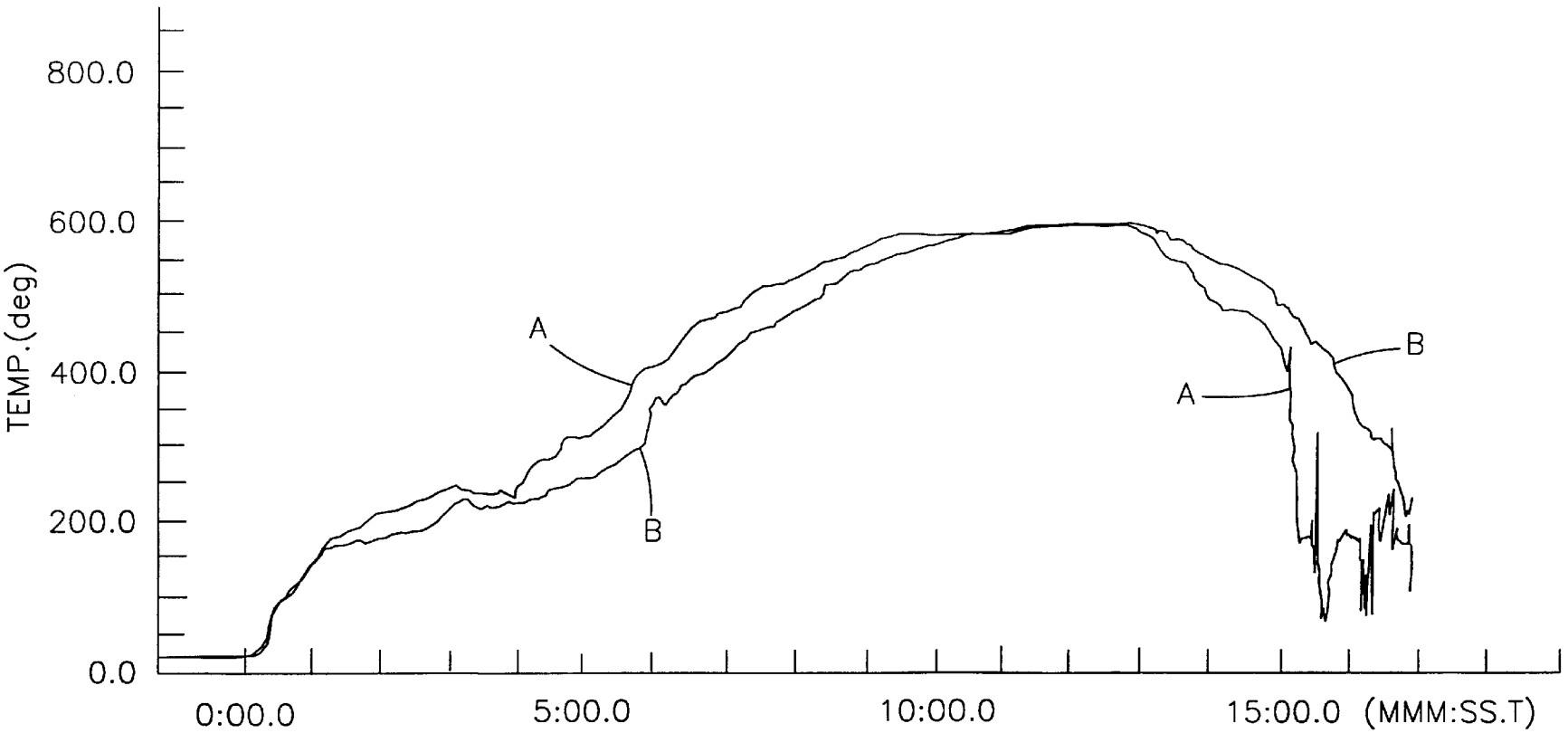
FIG. 4 is a graph showing the improved heating rate of a manifold block configured in accordance with this invention as compared to a prior art manifold block configured in accordance with FIG. 1.

FIG. 4 is a graph showing the improved heating rate of a manifold block modified in accordance with the invention. The data in the graph was obtained during a braze cycle in which manifold blocks of the type shown in the Figures were simultaneously brazed to jumper tubes and manifolds. The temperatures indicated in the graph were measured near the port holes of a modified block equipped with the longitudinal fins 116, counterbore 120 and undercut mounting flange 112 shown in FIG. 2 (Curve "A" in the graph) and the prior art block 10 of FIG. 1 (Curve "B" in the graph). The temperature of the prior art block 10 significantly lagged behind that of other parts of the manifold assembly, including the jumper tube, because of the relatively large thermal mass of the block 10. In contrast, the surface enhancements of the block modified in accordance with the invention promoted a significantly faster block heating rate around the port hole, a longer duration at the peak braze temperature, and a faster cooling rate. Importantly, during the brazing cycle depicted by the graph, the counterbore 120 prevented the molten braze metal from flowing away from the tube/block joint and toward the hotter fins 116.

The manifold block 210 shown in FIG. 3 is yet another embodiment of the invention. The block 210 is again of the type shown in FIG. 1, but modified to incorporate a cylindrical boss 232 within a counterbore 220 surrounding a port hole 214, the latter two being essentially identical to the counterbore 120 and port hole 114 of FIG. 2. In addition to serving as a reservoir for molten braze metal during the braze cycle (similar to the counterbore of FIG. 2), the boss 232 also promotes heat transfer to the tube/block joint by reducing the mass of the block 210 in the immediate vicinity of the joint. While shown without the other surface enhancements of this invention, it would generally be beneficial to employ the boss 232 in conjunction with the fins 116 and 128 and the undercut mounting flange 112 shown in FIG. 2.

In an investigation leading to this invention, uniform brazements were formed between jumper tubes and manifold blocks configured in accordance with this invention. A first braze test was performed with a manifold block equipped with the longitudinal fins 116 and counterbore 120 of FIG. 2, but without the lateral fins 128 and undercut mounting flange 112. Prior to brazing, a preform braze ring was placed on the tube, and subsequently received in the counterbore 120 when the tube was assembled to the block. The braze ring served as the source for the braze metal during the brazing cycle. During brazing at about 1155° F. (about 624° C.), good braze metal flow occurred between the block and the tube as a result of improved and more uniform heating of the block and tube. Once molten, the braze metal was contained by the counterbore 120 and therefore prevented from flowing away from the tube/block joint and toward the fins 116.

In a second braze test, a manifold block of a type shown in the Figures was modified to have only the longitudinal fins 116 and undercut mounting flange 112. The block underwent a braze operation essentially identical to that of the first test, by which a jumper tube of a type shown in FIG. 2 was brazed within the port hole of the block. Again, good braze metal flow occurred between the block and tube.

A third braze test was performed with a manifold block modified to have the longitudinal fins 116, counterbore 120 and undercut mounting flange 112 of FIG. 2. Improved quality of the brazement was again contributed to improved braze metal flow as a result of more uniform heating of the block and tube.

While the invention has been described in terms of a preferred embodiment, it is apparent that other forms could be adopted by one skilled in the art. For example, the particular appearance of the fins, grooves, counterbore and undercut could differ from that portrayed in the Figures. In addition, these enhancements can be used in combinations other than those shown. Accordingly, it should be understood that the invention is not limited to the specific embodiments illustrated in the Figures, but instead is to be limited only by the following claims.

What is claimed is:

1. A heat exchanger manifold block configured for attachment by brazing to a heat exchanger manifold by orienting the manifold block to have a longitudinal axis thereof substantially parallel to a longitudinal axis of the manifold, the manifold block comprising:

a longitudinal surface substantially parallel to the longitudinal axes of the manifold block and the manifold;

a second surface of the manifold block;

a port hole in the second surface of the manifold block, the port hole being configured to receive a jumper tube to which the manifold block is configured for attachment;

fins projecting from at least one of the longitudinal and second surfaces of the manifold block, the fins promoting convective and radiative heat transfer to the manifold block so as to increase the heating rate of the manifold block during brazing of the manifold block to the jumper tube and the manifold; and a counterbore surrounding the port hole, the counterbore being sized to serve as a reservoir for molten braze metal and to prevent molten braze metal from flowing away from the jumper tube and toward the fins during brazing of the jumper tube to the port hole.

2. The heat exchanger manifold block set forth in claim 1, further comprising the jumper tube brazed to the port hole of the manifold block.

3. The heat exchanger manifold block set forth in claim 1, further comprising the manifold brazed to the manifold block.

4. The heat exchanger manifold block set forth in claim 1, wherein the fins are defined by longitudinal grooves extruded into the longitudinal surface of the manifold block.

5. The heat exchanger manifold block set forth in claim 1, further comprising a mounting flange configured to mate with the manifold for attachment of the manifold block to the manifold.

6. The heat exchanger manifold block set forth in claim 5, wherein the mounting flange is spaced longitudinally from the second surface of the mounting block.

7. The heat exchanger manifold block set forth in claim 6, further comprising the manifold brazed to the mounting flange of the manifold block.

8. The heat exchanger manifold block set forth in claim 1, wherein the fins comprise a set of longitudinal fins that project from the longitudinal surface and a set of lateral fins that project from the second surface.

9. The heat exchanger manifold block set forth in claim 1, further comprising a cylindrical boss within the counter bore and surrounding the port hole.

10. The heat exchanger manifold block set forth in claim 9, further comprising the jumper tube brazed to the cylindrical boss.

11. A heat exchanger manifold block brazed to a jumper tube and a heat exchanger manifold, the manifold block having a longitudinal axis substantially parallel to a longitudinal axis of the manifold, the manifold block comprising:

a longitudinal surface substantially parallel to the longitudinal axes of the manifold block and the manifold;

a lateral end surface substantially perpendicular to the longitudinal surface of the manifold block;

a mounting flange mated with and brazed to the manifold, the mounting flange being spaced longitudinally from the lateral end surface of the mounting block;

a port hole in the lateral end surface of the manifold block, the jumper tube being received in and brazed to the port hole;

longitudinal fins projecting from the longitudinal surface of the manifold block and lateral fins projecting from the lateral end surface of the manifold block, the lateral fins and the longitudinal fins promoting convective and radiative heat transfer to the manifold block so as to increase the heating rate of the manifold block during brazing of the manifold block to the jumper tube and the manifold;

a counterbore surrounding the port hole, the counterbore being sized to serve as a reservoir for molten braze metal and to prevent molten braze metal from flowing away from the jumper tube and toward the fins during brazing of the jumper tube to the port hole; and a cylindrical boss within the counter bore and surrounding the port hole, the cylindrical boss having a distal end that does not project beyond the lateral end surface of the manifold block, the jumper tube being brazed to the cylindrical boss.

12. A method of brazing a heat exchanger manifold block to a heat exchanger manifold and a jumper tube, the method comprising the steps of:

forming the manifold block to have a longitudinal axis, a longitudinal surface substantially parallel to the longitudinal axis of the manifold block, a second surface substantially perpendicular to the longitudinal surface of the manifold block, a port hole in the second surface of the manifold block, fins projecting from at least one of the longitudinal and second surfaces of the manifold block, and a counterbore surrounding the port hole; and assembling the manifold block, the jumper tube and the manifold by installing the jumper tube in the port hole and mating the manifold block with the manifold so that the manifold block is oriented to have the longitudinal axis thereof substantially parallel to a longitudinal axis of the manifold; and then brazing the manifold block to the jumper tube and the manifold, the fins promoting convective and radiative heat transfer to the manifold block so as to increase the heating rate of the manifold block, the counterbore serving as a reservoir for molten braze metal and preventing molten braze metal from flowing away from the jumper tube and toward the fins.

13. The method set forth in claim 12, wherein the fins are formed by extruding grooves into the longitudinal surface of the manifold block.

14. The method set forth in claim 12, wherein the manifold block is further formed to have a mounting flange that is mated with the manifold during the assembling step and brazed to the manifold during the brazing step, the mounting flange being formed so as to be spaced longitudinally from the second surface of the mounting block.

15. The method set forth in claim 12, wherein the assembling step further comprises assembling a braze metal ring within the counterbore so as to be between the jumper tube and the manifold prior to the brazing step, the braze metal ring being a source of the molten braze metal during the brazing step.

16. The method set forth in claim 12, wherein the fins are formed so as to include a set of longitudinal fins that project from the longitudinal surface and a set of lateral fins that project from the second surface.

17. The method set forth in claim 12, wherein the manifold block is further formed to have a cylindrical boss within the counter bore and surrounding the port hole.

18. The method set forth in claim 17, wherein the jumper tube is brazed to the cylindrical boss during the brazing step.

19. The method set forth in claim 12, wherein the second surface is a lateral end surface of the manifold block.

20. The method set forth in claim 19, wherein the manifold block is further formed to have:

a mounting flange that is mated with the manifold during the assembling step and brazed to the manifold during the brazing step, the mounting flange is formed to be spaced longitudinally from the second surface of the mounting block;

lateral fins projecting from the second surface, the lateral fins promoting convective and radiative heat transfer to the manifold block so as to increase the heating rate of the manifold block during the brazing step;

a cylindrical boss within the counter bore and surrounding the port hole, the cylindrical boss having a distal end that does not project beyond the second surface of the manifold block, the jumper tube being brazed to the cylindrical boss during the brazing step.

* * * * *